United States Patent [19]

Warnod

[11] 4,396,908

[45] Aug. 2, 1983

[54] ELECTROMAGNETIC WARNING INSTRUMENT

[75] Inventor: Bertrand A. Warnod, Neuilly, France

[73] Assignee: Klaxon S.A., Courbevoie, France

[21] Appl. No.: 257,021

[22] Filed: Apr. 24, 1981

Related U.S. Application Data

[63] Continuation of Ser. No. 87,615, Oct. 23, 1979, abandoned.

[30] Foreign Application Priority Data

Oct. 27, 1978 [FR] France ..... 78 30608

[51] Int. Cl.[3] ..... G08B 3/00

[52] U.S. Cl. ..... 340/384 R; 340/388; 340/391; 340/393; 340/384 E

[58] Field of Search ..... 340/384 R, 388, 391, 340/393, 404, 384 E

[56] References Cited

U.S. PATENT DOCUMENTS

| | | | |
|---|---|---|---|
| 3,516,088 | 6/1970 | Allport | 340/388 |
| 3,631,481 | 12/1971 | Haus | 340/388 |
| 3,887,914 | 6/1975 | Sato et al. | 340/384 R |
| 3,945,004 | 3/1976 | Myers | 340/384 R |
| 4,149,153 | 4/1979 | Shigemori et al. | 340/384 R |
| 4,163,223 | 7/1979 | Sato et al. | 340/384 R |

*Primary Examiner*—Donnie L. Crosland

*Attorney, Agent, or Firm*—James Creighton Wray

[57] ABSTRACT

An electromagnetic warning instrument has a housing equipped with at least one core carrying an operating electric coil, and a contact-breaker cooperating with a vibrating armature fast with a diaphragm. The coil is mounted on a printed circuit and electrically connected thereto. The printed circuit is mechanically fixed to the housing. The contact-breaker is mounted on the circuit by a mechanical connection which effects an electric connection. The printed circuit carrying the coil or coils can be assembled in advance, preferably by automatic means, then it is fixed on the housing, each coil being simply fitted on to the core. The fixing of the contact-breaker assembly then simultaneously ensures a supplementary mechanical connection for the printed circuit and the electric connection with the contact breaker.

7 Claims, 11 Drawing Figures

Fig. 7
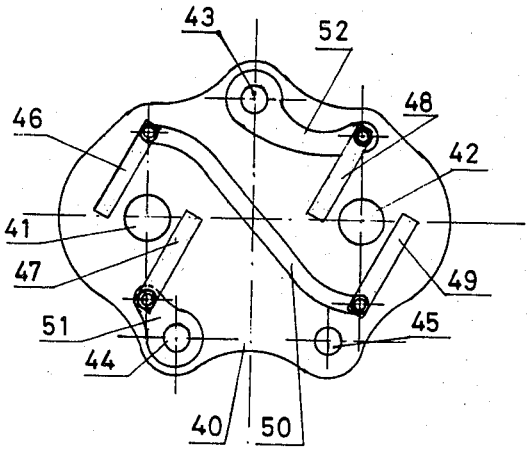
Fig. 8
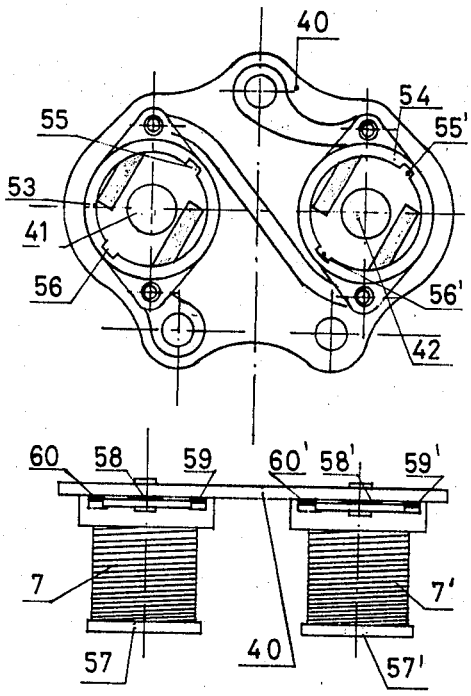
Fig.9
Fig. 10
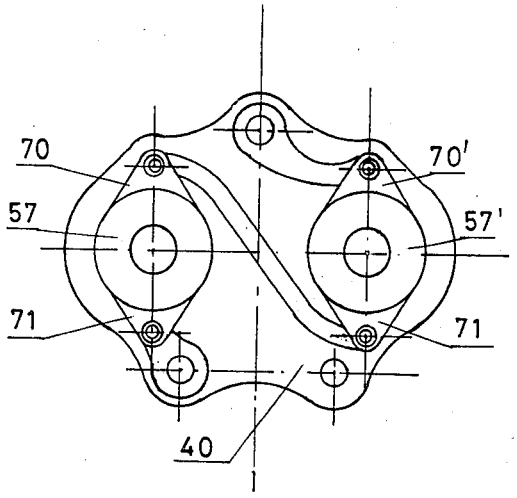
Fig . 11
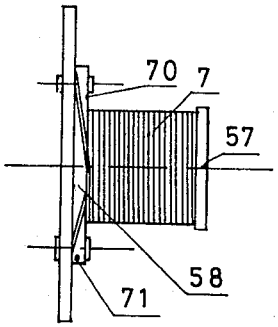

ELECTROMAGNETIC WARNING INSTRUMENT

This application is a continuation of application Ser. No. 087,615, filed Oct. 23, 1979, now abandoned.

BACKGROUND TO THE INVENTION

The invention relates to an electromagnetic warning device comprising a housing equipped with at least one core carrying an operating electric coil, and a contact-breaker cooperating with a vibrating armature fast with a diaphragm.

STATEMENT OF PRIOR ART

In known warning devices of this type the coils are mounted separately on their cores then electrically connected to the contact-breaker, generally constituted by a prefabricated assembly. The fitting of the coils and the soldering of their extremities are a delicate operation carried out manually, so that it is burdensome and unreliable. Moreover the fixing of the coils on the cores is generally effected by crimping, which further complicates the assembly of the warning device.

OBJECT OF THE INVENTION

The present invention aims at eliminating these drawbacks of known warning devices.

SUMMARY OF THE INVENTION

According to the invention there is provided an electromagnetic warning device comprising a housing, a printed circuit mechanically fixed to said housing, at least one electromagnet having a core and coil mounted on said printed circuit, said coil being electrically connected to said printed circuit, an armature movable by said electromagnet, a diaphragm connected to said armature, and a contact-breaker mounted on said printed circuit by a mechanical connection at the same time effecting an electrical connection to said printed circuit.

In the warning instrument according to the invention the printed circuit carrying the coil or coils can be assembled in advance, preferably by automatic means, then it is fixed on the housing, each coil being simply fitted on to the core. The fixing of the contact-breaker assembly then simultaneously ensures a supplementary mechanical connection for the printed circuit and the electric connection with the contact-breaker.

BRIEF DESCRIPTION OF DRAWINGS

The invention will be clearly understood on reading of the following description given with reference to the accompanying drawings, wherein:

FIG. 7 is a plan view of a printed circuit utilisable in a variant of the invention, FIG. 8 is analogous with FIG. 7, but after fitting of the securing sleeves of the coils, FIG. 9 is a plan view of the assembly according to FIG. 7, after fitting of the coils, FIG. 10 is a plan view of a printed circuit carrying coils according to a variant of the invention, and FIG. 11 is a plan view of the assembly according to FIG. 10.

Figure 1:
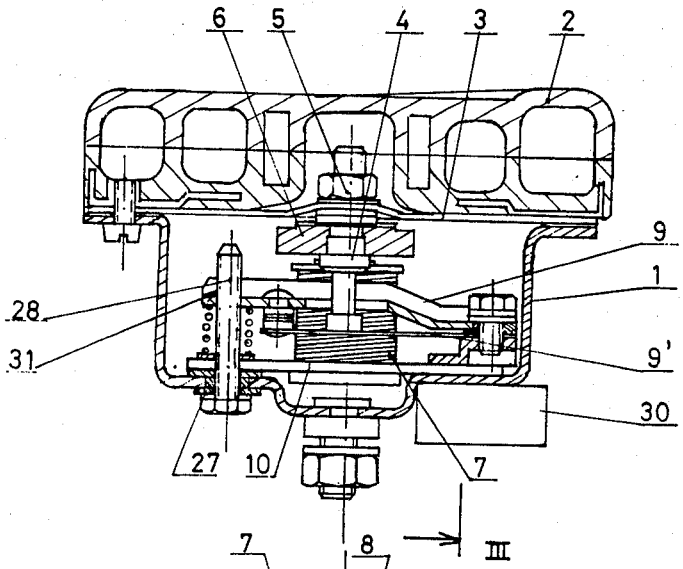
FIG. 1 is a diametrical sectional view, partially in elevation, of a warning instrument according to one example of embodiment of the invention.
Figure 2:
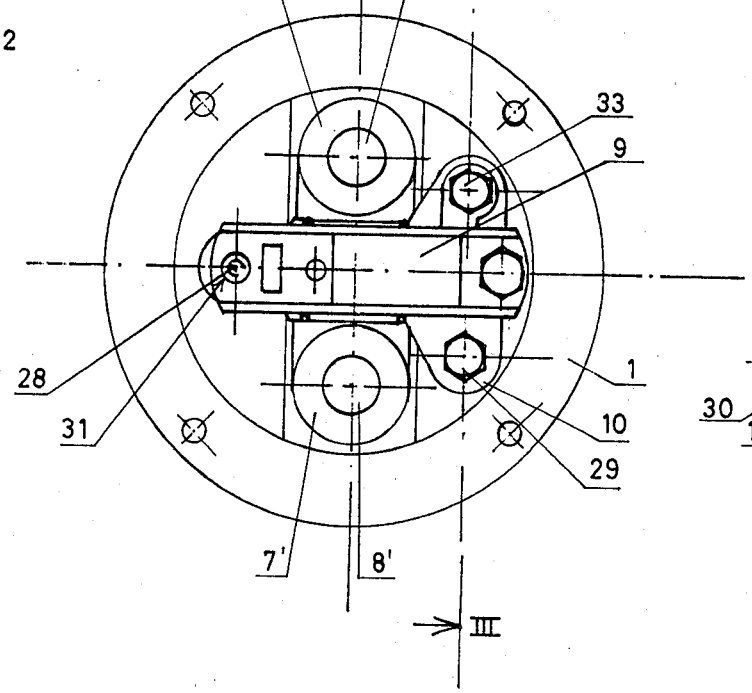
FIG. 2 is a plan view of the plate of the warning instrument according to FIG. 1.
Figure 3:
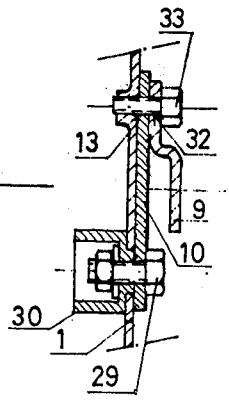
FIG. 3 is a sectional view along the line III—III in FIG. 2.
Figure 4:
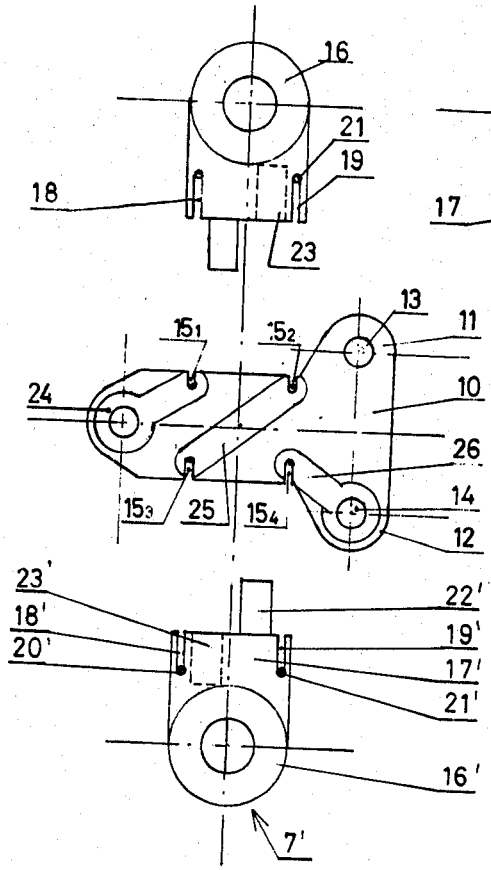
FIG. 4 is a plan view of a printed circuit and two coils of the warning instrument according to FIGS. 1 to 3, before assembly.
Figure 5:
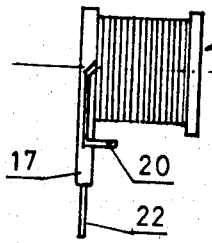
FIG. 5 is a view in lateral elevation of one of the coils according to FIG. 4.
Figure 6:
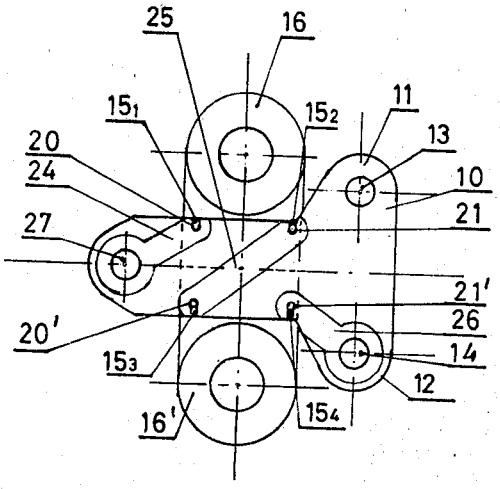
FIG. 6 is a plan view of the assembly according to FIG. 4 after assembly.

The warning instrument as represented in the drawing by way of example has two operating coils and one single connection terminal.

DESCRIPTION OF PREFERRED EMBODIMENT

The warning instrument comprises a sheet metal housing 1 on which casing 2 provided with a labyrinth chamber is screwed, a diaphragm 3 being interposed. The diaphragm carries a spindle 4 fixed by a nut 5 and equipped with a vibrating armature 6. The armature 6 is subjected to the field created by two electric coils 7 and 7', each surrounding a core 8, 8' fast with the carcass 1. The supplying of the coils 7 and 7' takes place through a contact-breaker assembly constituted by a bridge 9 and a spring blade 9', each equipped with a contact bead. the blade 9' is subject to the mechanical action of the free extremity of the spindle 4.

In accordance with the invention the coils 7 and 7' are fitted in advance on a printed circuit 10. In the form of embodiment as described the circuit 10 comprises two securing lugs 11 and 12 provided with passage holes 13 and 14 respectively. The circuit 10 further comprises four notches $15_1$, $15_2$, $15_3$ and $15_4$ disposed on the corners of a rectangle.

The two coils 7 and 7' are absolutely identical, both as regards their spools and as regards the number of turns and the direction of winding. The spools 16, 16' in each case is one piece with a flat output 17, 17' prolonging one of the coil flanges. The support 17, 17' comprises two parallel notches 18, 18' and 19, 19' to the bottom of each of which there is brought, perpendicularly to the support, a coil winding extremity 20, 20' and 21, 21' respectively. Each support 17, 17' further comprises a lateral extension lug 22, 22' and an internal recess 23, 23'.

The two supports 17 and 17' are assembled one into the other by penetration of the lug 22 into the recess 23' and of the lug 22' into the recess 23, the notches 18, 19, 18', 19' respectively imprisoning the extremities of the coils 20, 21, 20', 21' in the bottoms of the notches $15_1$, $15_2$, $15_3$, $15_4$. The electric connection with the conductors 24, 25 and 26 of the circuit 10 is effected by soldering.

The conductor 24 connects the extremity 20 of the coil 16 to a contact surrounding a hole 27 in the circuit 10. The conductor 25 connects the extremity 21 of the coil 16 to the extremity 20' of the coil 16'. Finally the conductor 26 connects the extremity 21' of the coil 16' to a contact surrounding the hole 14 in the circuit 10.

The assembly of the warning instrument is simplified and can be automated. Firstly a regulating screw 28 is positioned on which the printed circuit 10 is fitted, the hole 27 of which surrounds the screw, the coils 7, 7' coming to be lodged around the cores 8, 8'. Then a screw 29 is positioned which retains an insulating block 30 and is lodged in the hole 14 in the circuit. The block 30 serves as insulation for the connection terminal of the warning instrument, constituted by the screw 29.

Next the contact-breaker assembly 9-9' is positioned, which comprises a passage hole 31 for the screw 28 and a second hole 32 opposite to the hole 13 in the circuit 10. The screw 28 serves for the regulation of the contact-breaker and connects it electrically to the conductor 24 of the circuit 10. A screw 33 is fitted into the holes 32 and 13 so that the contact-breaker is connected to the earth constituted by the housing 1 of the warning instrument.

Reference will now be made to FIGS. 7 to 9 which represent a variant of embodiment of the printed circuit utilisable in the warning instrument according to the invention. The printed circuit 40 comprises two holes 41 and 42 for the passage of the cores 8, 8' and three passage holes 43, 44, 45. In the vicinity of the hole 41 there are fitted two flexible contacts 46 and 47, and in the vicinity of the hole 42 there are fitted two flexible contacts 48 and 49. The contact 46 is connected to the contact 49 by a conductor 50 of the circuit 10. The contact 47 is connected to the periphery of the hole 44 by a conductor 51 of the circuit 10 while the contact 48 is connected to the periphery of the hole 43 by a conductor 52. The holes 43 and 44 have the same function as the holes 27 and 14 in the previous form of embodiment, while the hole 45 corresponds to the hole 13.

On the circuit 40 there are mounted two sleeves 53 and 54 (FIG. 8) coaxial with the holes 41 and 42 respectively. The sleeve 53 is provided with two internal notches 55 and 56 while the sleeve 54 is provided with two internal notches 55' and 56'. The coils 7 and 7' are mounted on supports 57, 57' one of the flanges 58, 58' respectively of which comprises radial nipples cooperating with the notches 55, 56 and 55', 56' respectively. Moreover the winding ends of each of the coils are connected each to a contact 59, 60 and 59', 60' on the outer face of the flange 58 or 58' respectively.

After introduction of the nipples into the respective notches the support 57, 57' is rotated until the nipples abut on the bottom of lodgements extending the notches. The contacts 60, 59 come to lodge on the contacts 46, 47 and the contacts 60', 59' come to lodge on the contacts 48, 49. The supports 57, 57' are held by the elastic pressure of the contacts 46, 47 and 48, 49 respectively, the assembly forming a bayonet catch.

The form of embodiment according to FIGS. 10 and 11 is similar to that of FIGS. 7 to 9 and the same references designate the same parts. The supports 57 and 57' of the coils 7 and 7' comprise lugs 70, 71 and 70', 71' pierced with a hole on their respective flanges 58, 58'. One end of each coil is connected to the periphery of one of the holes and the support is fixed on the circuit 40 by riveting or screwing, in such manner as simultaneously to effect the electric connection with the adjacent conductor of the printed circuit.

I claim:

1. An electromagnetic warning device comprising:

(a) a housing;

(b) a printed circuit mechanically fixed to said housing;

(c) at least one electromagnet having a core and coil mounted on said printed circuit, said coil being electrically connected to said printed circuit;

(d) an armature movable by said electromagnet;

(e) a diaphragm connected to said armature; and (f) a contact-breaker mounted on said printed circuit by a mechanical connection which effects an electrical connection to said printed circuit.

2. A warning device according to claim 1, wherein the coil is equipped with a flange of which there arrive the two wire ends of the coil and the printed circuit comprises flexible contacts cooperating with the said ends by fixing of the flange on the circuit.

3. A warning device according to claim 2, wherein the printed circuit comprises a sleeve for fixing a coil and means for locking the coil on the sleeve.

4. A warning device according to claim 3, in which the said locking means are of the bayonet type.

5. A warning device according to claim 1, wherein the coil is equipped with two protuberances for fixing on which there respectively arrive the two coil wire extremities, and the coil is connected to the printed circuit by two mechanical conductor elements respectively connecting one extremity of the coil wire to a conductor of the printed circuit.

6. A warning device according to claim 1, wherein two identical coils are provided each comprising a flange equipped with a lug and a receiver recess, the ends of the coil wire of each coil being brought on to their respective flanges, the lug of one coil being lodged in the recess of the other coil, conductors of the said printed circuit being soldered to the said extremities of the coil wire.

7. An electromagnetic warning device comprising a housing, a printed circuit board mechanically fixed to said housing, a printed circuit on said board, two identical electromagnets having identical cores and identical coils mounted on said printed circuit board, said identical coils being electrically connected to said printed circuit, wherein said two identical coils are provided each with a flange, and wherein each flange has a lug and a receiver recess, the ends of coil wires of the coils being fixed on their respective flanges, the lug of one coil being lodged in the recess of the other coil, conductors of the said printed circuit being soldered to the said ends of the coil wires, and armature movable by said electromagnets, a diaphragm connected to said armature, and a contact-breaker mounted on said printed circuit board by a mechanical connection which effects an electrical connection to said printed circuit.

* * * * *